United States Patent [19]

Colley

[11] 4,330,234

[45] May 18, 1982

[54] ROTOR TIP CLEARANCE CONTROL APPARATUS FOR A GAS TURBINE ENGINE

[75] Inventor: Rowan H. Colley, Sunnyhill, England

[73] Assignee: Rolls-Royce Limited, London, England

[21] Appl. No.: 115,555

[22] Filed: Jan. 21, 1980

[30] Foreign Application Priority Data

Feb. 20, 1979 [GB] United Kingdom ..... 7905999

[51] Int. Cl.[3] ..... F01D 11/08

[52] U.S. Cl. ..... 415/171; 415/127; 415/138

[58] Field of Search ..... 415/171, 138, 126, 131, 415/127

[56] References Cited

U.S. PATENT DOCUMENTS 3,520,635 7/1970 Killmann et al. ..... 415/138
4,127,357 11/1978 Patterson ..... 415/138 X
4,131,388 12/1978 Brodell ..... 415/138
4,247,247 1/1981 Thebert ..... 415/171 X

FOREIGN PATENT DOCUMENTS 227536 3/1959 Australia ..... 415/171
1291560 3/1969 Fed. Rep. of Germany ..... 415/171
1426818 3/1969 Fed. Rep. of Germany ..... 415/171

*Primary Examiner*—Everette A. Powell, Jr.
*Attorney, Agent, or Firm*—Cushman, Darby & Cushman

[57] ABSTRACT

A rotor tip clearance control apparatus for a gas turbine engine comprises an annular shroud member which forms part of the static structure of the apparatus. The shroud member has an internal frusto-conical surface which co-operates with the outer extremities of the rotor to define a small clearance. In order to control this clearance the shroud member is mounted from fixed structure by rotatable eccentrics which can move the member axially and thus affect the clearance in a predetermined manner.

13 Claims, 5 Drawing Figures

ROTOR TIP CLEARANCE CONTROL APPARATUS FOR A GAS TURBINE ENGINE

This invention relates to a rotor tip clearance control apparatus for a gas turbine engine.

Increasingly the designers of modern gas turbine engines have been concerned with the problems arising from the variation in clearances between various of the rotors and adjacent static structures of the gas turbine engine. One particular area where this is true is the seal between the rotor blades of the turbine and the static shroud structure immediately outside these rotor blades. Because of centrifugal loads and differential thermal effects the clearance between the tips of the rotor blades and the static structure can vary considerably unless the apparatus is specifically designed so that the static structure can expand and contract in a way to match the expansion and contraction of the rotor.

One possible solution to these problems lies in the use of the static structure having a frustoconical internal surface which co-operates with the blade tips to form the desired small clearance. In this case by arranging for axial movement of the shroud it is possible to vary the clearance in a pre-determined manner or to maintain it at a pre-determined value.

One problem with this method of control lies in the relatively high loads imposed on the movable ring by sealing devices and gas loads. The present invention provides a way in which a shroud of this kind may be actuated so as to provide high actuating forces on the ring which can then be used to overcome the sealing forces etc.

According to the present invention, the rotor tip clearance control apparatus for a gas turbine engine comprises static structure including an annular shroud member, said member having an internal frustoconical face and said rotor having outer extremities which co-operate with said face to define a small clearance therewith, and a plurality of eccentrics supporting said annular shroud member from said static structure, the eccentrics being rotatable so that they can move the member axially and thus can effect the clearance in a pre-determined manner.

Preferably the eccentrics are carried from radially extending shafts and engage in recesses in an outer surface of the shroud ring. In this way the ring is allowed to expand radially but is held concentric with the rotor axis.

It may be necessary to relieve the surfaces of the eccentrics or of bushings through which they engage with the recesses so as to allow for the inaccuracies in geometry when the eccentrics cause the ring to translate circumferentially.

Each of the shafts is preferably actuated about its axis by a lever. Preferably the levers are all connected to a unison ring which will ensure that all the levers are moved together. The unison ring may be actuated by actuators such as screw jacks.

Figure 1:
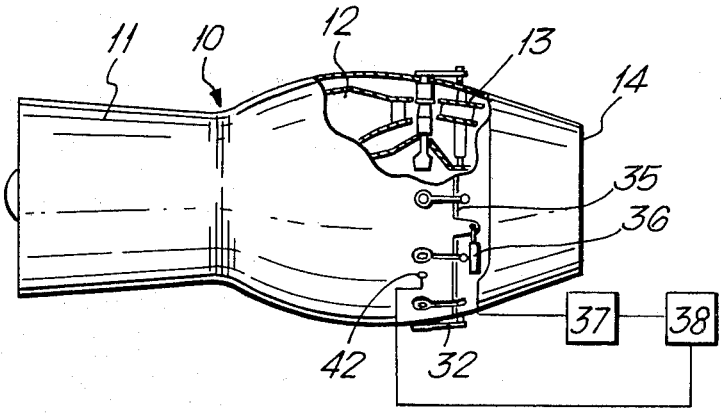
Figure 3:
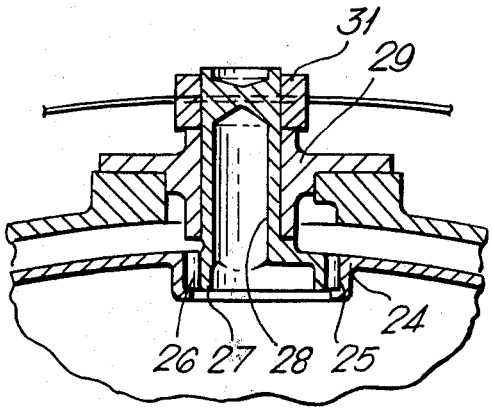
Figure 2:
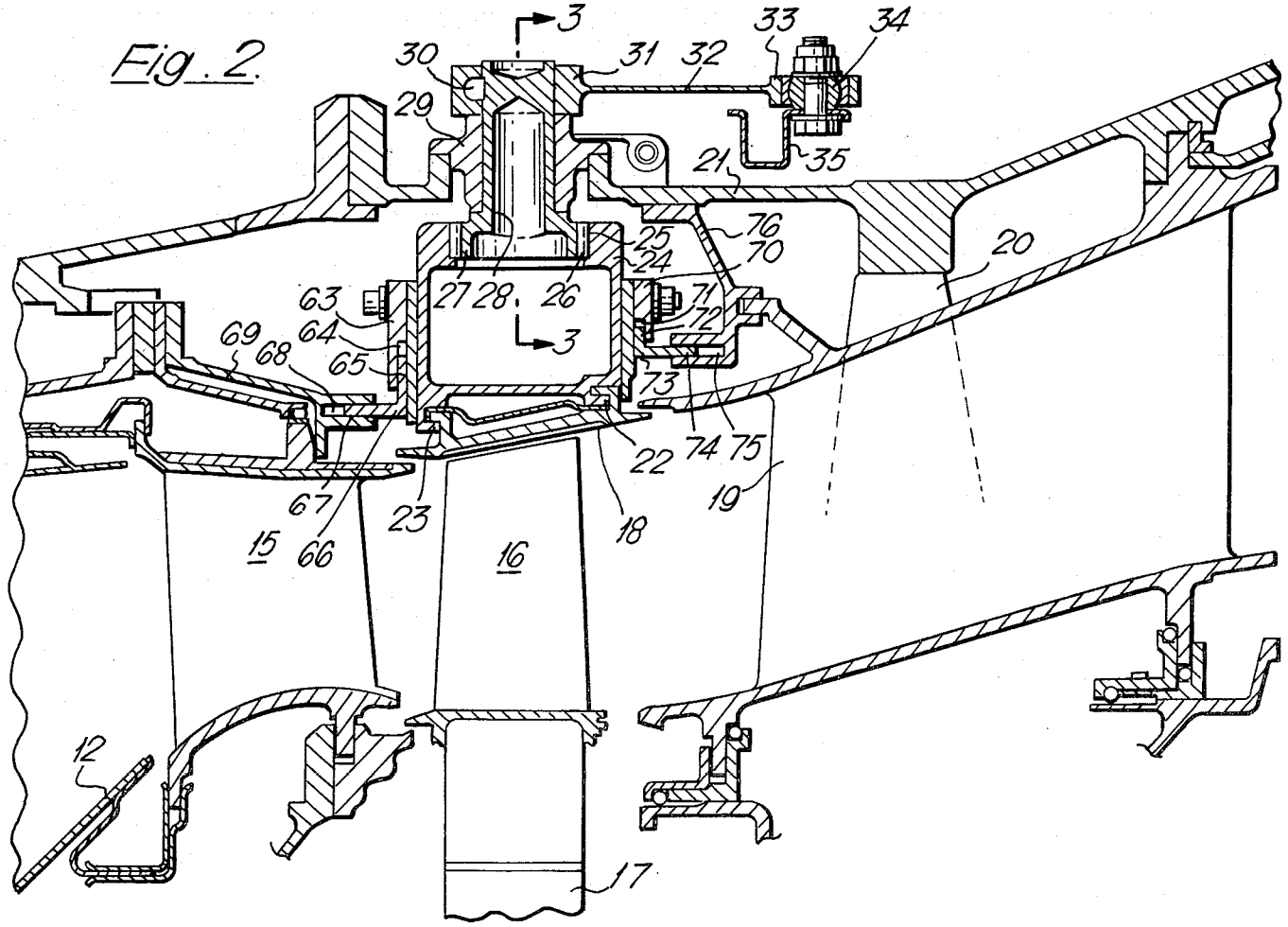
Figure 4:
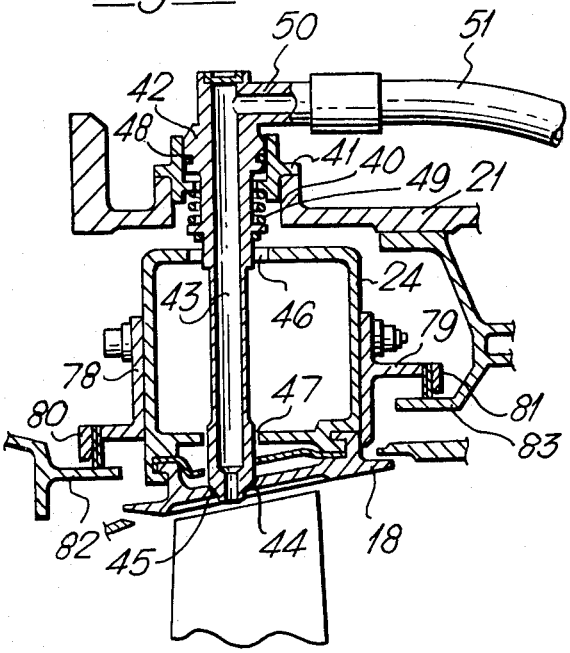
Figure 5:
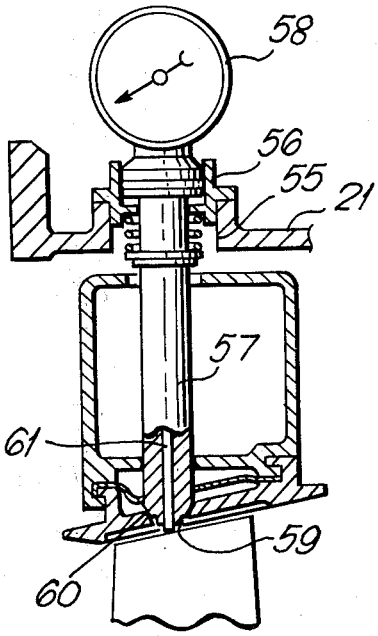

The invention will now be particularly described merely by way of example and with reference to the accompanying drawings in which:

FIG. 1 is a partly broken away view of a gas turbine engine having apparatus in accordance with the invention, FIG. 2 is an enlarged section through the turbine area of FIG. 1, FIG. 3 is a section on the line 3—3 of FIG. 2, FIG. 4 is a section similar to part of FIG. 2 but displaced circumferentially and FIG. 5 is a section similar to that of FIG. 4 but showing apparatus used in setting up the device.

In FIG. 1 there is shown a gas turbine engine comprising a casing 10 within which are mounted a compressor 11, a combustion system 12 and a turbine 13. The casing forms at its downstream end a final nozzle 14. Operation of the engine in general is conventional and is not described in this specification.

FIG. 2 shows in greater detail the turbine area. It will be seen that broadly this area includes a series of nozzle guide vanes 15 which directs the hot gases from the combustion chamber 12 on to a stage of rotor blades 16. The rotor blades 16 are in turn supported from a rotor disc 17 which is carried in bearings (not shown). At their outer extremities the blades 16 run very close to an annular shroud 18. The very small clearance between the rotor blades 16 and the shroud 18 is very important to the overall efficiency of the turbine and it must be maintained as small as possible but must not be allowed to close up completely so that the blades and/or the shroud will be damaged. Downstream of the blade 16 the hot gases pass through a plurality of outlet guide vanes 19 and finally escape to atmosphere through the nozzle 14. In addition to acting as flow straightening vanes, the vanes 19 are hollow so that a plurality of struts 20 can pass through their hollow interiors and support the bearing of the rotor disc 17. The struts 20 are carried from a casing 21 of the engine.

As mentioned above it is important that the clearance between the shroud 18 and the blades 16 should be maintained at a small value. To this end the shroud member 18 made up of an annular array of shroud elements is carried by hook like engagements 22 and 23 from the hollow ring 24. The ring 24 comprises in general a hollow rectangular section and in its outer circumference are formed a plurality of circular recesses 25 in each of which an anti-friction, bushing 26 is mounted. A similar plurality of eccentrics 27 are provided each of which fits closely within its associated bushing 26. Each eccentric 27 forms the end portion of a radial shaft 28 which is rotatably supported in a guide 29 carried in the casing 21.

It will be seen that the provision of a plurality of the eccentrics 27, mounted with substantially radial axes, provides a location for the ring 24, which is concentric with respect to the casing 21. Hence, the ring 24 being concentric with the casing 21 will also be concentric with the blades 16 through the struts 20 which support the bearings and disc 17. The radial eccentrics 27 will also allow radial expansion of the ring 24 under differential thermal stresses.

Each of the shafts 28 is attached by means of a key 30 to a collar 31 which is mounted at one end of the lever 32. Each lever 32 has a second collar 33 at its outer end and is attached through a spherical joint 34 to a unison ring 35. It will be appreciated that by their attachment to the unison ring 35 the levers 32 are forced to move in unison. It will also be appreciated that if the ring 35 is moved circumferentially it will displace all the levers 32 and hence rotate all the shafts 28. This will cause rotation of the eccentrics 27 and consequent displacement of the ring 24 in the circumferential and in the axial sense. The circumferential movement will not affect the relationship between the shroud ring 18 and the blades 16, but by virtue of the frustoconical inner surface of the shroud 18 any axial movement of the ring 24 will have an effect on the clearance between the shroud 18 and the blade 16. Therefore it is possible by moving the ring 35 to vary the clearance and it will be appreciated that if the clearance is monitored it will be possible to move the ring in such a manner as to reduce the clearance to a specified minimum value, provided of course that the eccentrics and the angle of the inner surface of the shroud are such as to provide sufficient movement.

It should be noted that because of the relevant circumferential displacement between the unison ring 35, the shafts 28 and the shroud carrying ring 24 the various pivots will not be always operating about parallel axes. Only a small degree of displacement is involved and it is possible to allow for the displacement between ring 35 and shaft 28 by making the levers 32 slightly flexible. However, it may be found necessary either to relieve the surfaces of the eccentrics 27 or those of the bushings 26 to allow for the displacement between the shafts 28 and the ring 24.

As referred to above it is necessary to provide an actuation system for the ring 35 and referring once more to FIG. 1 a screw jack 36 is shown connected to the ring 35 so that it can move it circumferentially. In practice it is likely that a plurality of the jacks 36 would be used each being connected to a common motor which is shown at 37. In order to control the motor 37 so that it actuates the ring 35 correctly a control system 38 is shown. This control system takes in input from a sensor which measures the clearance between the blades 16 and the shroud 18 and makes consequent variations in the position of the ring 35.

FIG. 4 shows one way in which a sensor may be provided to measure the clearance between the blades 16 and ring 18. In this case an aperture 40 in this casing 21 engages sleeve 41 through which a probe 42 projects. The probe 42 basically comprises a hollow tube having a central aperture 43. At its innermost extremity the probe 42 has a spherical end 44 which engages with a corresponding spherical concavity 45 in the shroud 18. Apertures 46 and 47 are also provided in the ring 24 so that the probe can pass through unobstructed. A seal at 48 between the probe 42 and sleeve 41 prevents escape of gases to atmosphere and a spring 49 engaging between the sleeve 41 and the probe 42 pushes the spherical end 44 into constant engagement with the concavity 45. At its outer end the probe 42 has a connection 50 which connects it to a pipe 51 which in turn is connected to the control unit 38. In operation the control unit 38 feeds a supply of pressurised air through the pipe 51 to the probe 52. Clearly each time a blade passes the end 44 of the probe the pressure in the probe and hence in the pipe will be affected depending upon the smallness of the clearance between the blade and the shroud. By measuring this pressure an indication may be obtained of the clearance and the control system 38 may be caused to act to either reduce or increase the clearance to a pre-determined value. In practice a plurality of sensors would probably be used so that cyclic errors such as those arising from non-circularity of components may be averaged out.

As was mentioned above the mounting of the ring 24 through the shafts 28 to the casing 21 allows the concentricity of the shroud 18 and the blades 16 to be maintained. However, it may be necessary to set up the ring 24 so that it is initially concentric with the turbine rotor.

FIG. 5 shows how a measuring gauge may be used to set up the ring 24 concentric with the turbine rotor. It will be seen that in an aperture 55 in the casing 21, which may in fact comprise one of the apertures 40, a sleeve 56 is used to mount a probe 57 which comprises the extension from a clock gauge 58. The extension 57 has a spherical end 59 which seats in a spherical concavity 60 in a similar manner to the end 44 of the probe 42. It will be appreciated that by causing the operating rods 61 of the gauge 58 to contact the tip of a blade 16 a direct measure of the clearance between the blade tip and the shroud may be obtained. By measuring this clearance at positions spaced apart round the periphery of the casing it is therefore possible to deduce any initial eccentricity between the turbine rotor and the ring 24.

If an eccentricity is deduced it is possible to correct for this by adjusting individual eccentrics 27. This may be done by rotating the respective shaft 28 with respect to its lever 32. Thus with the construction described above it will be possible to remove the key 30, to rotate the collar 31 with respect to the shaft 28 by the desired amount and to reintroduce the key 30. However, it may be advantageous to provide adjustment by other means such as a worm and wheel arrangement.

As so far described there is nothing to prevent the escape of hot gases from the mainstream of the engine into the area outboard of the shroud ring 18. It is therefore necessary to provide sealing rings which prevent escape of this gas and also prevent the gas bypassing the turbine blade 16. To this end an annular plate 63 is bolted to the front face of the ring 24. The plate is cut away at 64 so that it leaves an annular channel in which fits the radially outwardly projecting flange 65 of an L section sealing ring 66. The forwardly projecting flange 67 of this ring engages with an annular gap 68 formed in a static sealing member 69.

Similarly on the rear face of the ring 24 a plate 70 is attached and defines a gap 71. In this gap the radially outwardly projecting flange 72 of a second sealing ring 73 engages. The rearwardly projecting flange 74 engages in an annular gap 75 as in a second sealing member 76 mounted from the casing 21.

It will be seen that the L section of the rings 66 and 73 enables the ring 24 to move radially and axially whilst still maintaining a seal of the piston ring type. It will be appreciated that there are various alternative sealing methods available and in fact one of these is illustrated in FIG. 4. In this instance plates 78 and 79 attached to the front and rear faces respectively of the ring 24 carry respective brush seals 80 and 81. These seals engage with annular flanges 82 and 83 from adjacent fixed structure. It will be understood that seals of this nature which essentially comprise radially extending arrays of bristles may be expected to allow some radial movement as well as axial movement without losing their sealing effect.

It will be noted that in the FIG. 2 embodiment and in the FIG. 4 embodiment the seals 66 and 73 and 80 and 81 are carefully arranged to be on different diameters and the pressures around the ring 24 are arranged to be such that there is normally a net force on the ring due to these pressures pushing it to the left in the drawing. This is deliberately designed as a safety feature so that should the operating mechanism for the ring break, the ring will tend to move to the left so that it increases the clearance between the blades and the shroud. It will be understood that this is a much safer action than would be obtained if the ring moved too close down the clearance and possibly to contact the blades.

It will be appreciated that there are a number of modifications which could be made to the invention. Thus, although mounting of the eccentrics about radial axes is advantageous from the point of view of allowing expansion and providing accurate location it will be possible to use eccentrics mounted in other directions. Again it may be preferred to use the mechanism of the present invention in conjunction with other forms of adjustment of the blade clearance. Thus the hollow ring 24 lends itself very well to the introduction of hot or cold gas to its hollow interior and consequent thermal expansion contraction. This may be used to provide additional variation of the clearance and it may in any case be desirable to flood the ring with air at a specified temperature to avoid local distortions of the ring and thus of the shroud.

Although the present invention is mostly advantageously applied to a turbine it could easily be applied to a compressor situation and it should also be noted that in addition to the pneumatic method of sensing tip clearance referred to above it will be possible to use magnetic, electronic, optical or even mechanical methods of determining the actual clearance. It should also be noted that if the actuation system for the ring 24 is very quick operating it might be possible to use a control 38 which simply maintains the clearance at a set value. However, if the actuation system is relatively slow in operation it may be necessary to bias the control system so that at certain conditions of engine running such as idling the clearance is maintained at a large value. When the engine is brought up to operating speed the relatively fast expansion of the disc and blades will then be allowed to take place without the blades closing up the clearance faster than the actuation system can increase it.

I claim:

1. Rotor tip clearance control apparatus for a gas turbine engine comprising:

static structure;

an annular shroud member movable axially and radially relative to said static structure, said shroud member having an internal frusto-conical face;

a rotor having outer extremities cooperating with said frusto-conical face to define a small clearance therewith;

a plurality of rotatable eccentrics supporting said annular shroud member from said static structure, said plurality of eccentrics being rotatable on axes substantially radial of said annular shroud member; and means to rotate said eccentrics and move said shroud member axially whereby said clearance between the extremities of said rotor and said shroud is controlled in a predetermined manner.

2. Rotor tip clearance control apparatus as claimed in claim 1 and in which said annular shroud member has a plurality of recesses in its outside surface, one of said eccentrics engaging in each one of said recesses.

3. Rotor tip clearance control apparatus as claimed in claim 2 comprising a plurality of bushings, each being carried by one of said recesses and through which each eccentric engages with its corresponding recess.

4. Rotor tip clearance control apparatus as claimed in claim 2 including means compensating engagement between said eccentrics and their respective recesses to allow for inaccuracies of geometry when said eccentrics cause said annular shroud member to translate circumferentially.

5. Rotor blade tip clearance control as claimed in claim 3 including means compensating engagement between said bushing and said recesses to allow for inaccuracies of geometry when the eccentrics cause the annular shroud member to translate circumferentially.

6. Rotor tip clearance control apparatus as claimed in claim 1 in which each said eccentric is carried from a shaft, an actuating lever operatively connected to each shaft by which the shaft and respective eccentric may be rotated.

7. Rotor tip clearance control apparatus as claimed in claim 6 including a unison ring operatively connected to each actuating lever so that each lever may be moved in unison with every other lever.

8. Rotor tip clearance control apparatus as claimed in claim 7 including screw jacks mounted to move said unison ring circumferentially and hence to move said actuating levers.

9. Rotor tip clearance control apparatus as claimed in claim 1 comprising a sensor having an output responsive to the clearance between said annular shroud member and said rotor and control means operatively coupled to said eccentrics and responsive to said output, said control means operating said eccentrics to move said shroud member to vary said clearance in a predetermined manner.

10. Rotor tip clearance control apparatus as claimed in claim 1 in which said annular shroud member comprises a hollow support ring, said hollow support ring supporting an annular array of shroud elements, said shroud elements providing said frusto-conical surface.

11. Rotor tip clearance control apparatus as claimed in claim 5 in which each of said eccentrics is carried from a shaft, an actuating lever operatively connected to each shaft for rotating the same, a unison ring operatively connected to each actuating lever, means for rotating the unison ring to simultaneously move each lever and its respective eccentric, and in which said compensating means includes having each lever slightly flexible.

12. Rotor tip clearance control apparatus as claimed in claim 1 including first and second sealing means positioned upstream and downstream respectively of said shroud member between the shroud member and said fixed structure, said first and second sealing means being arranged to provide an axial force on said shroud member in a direction tending to increase said clearance between said shroud member and the extremities of said rotor should said means to operate said eccentrics fail.

13. Rotor tip clearance control apparatus as claimed in claim 12 in which said first and second sealing means are effective to permit relative axial and radial movement between said shroud member and said fixed structure.

* * * * *